US008607871B2

(12) United States Patent
Coyle, Jr.

(10) Patent No.: US 8,607,871 B2
(45) Date of Patent: Dec. 17, 2013

(54) OILFIELD JETTING TOOL

(75) Inventor: William E. Coyle, Jr., Houma, LA (US)

(73) Assignee: William E. Coyle, Jr., Houma, LA (US)

( * ) Notice: Subject to any disclaimer, the term of this patent is extended or adjusted under 35 U.S.C. 154(b) by 378 days.

(21) Appl. No.: 13/019,705

(22) Filed: Feb. 2, 2011

(65) Prior Publication Data

US 2012/0193100 A1 Aug. 2, 2012

(51) Int. Cl.
*E21B 37/00* (2006.01)

(52) U.S. Cl.
USPC ..... 166/311; 166/173; 166/312

(58) Field of Classification Search
USPC ..... 166/311, 312, 173
See application file for complete search history.

(56) References Cited

U.S. PATENT DOCUMENTS

| | | | | |
|---|---|---|---|---|
| 5,839,511 | A * | 11/1998 | Williams | 166/312 |
| 6,732,793 | B1 * | 5/2004 | Lee | 166/222 |
| 2007/0017679 | A1 * | 1/2007 | Wolf et al. | 166/312 |
| 2011/0203809 | A1 * | 8/2011 | Knobloch et al. | 166/386 |

OTHER PUBLICATIONS

Bilco Tool'S Riser Jet Tool; Admitted Prior Art.
Bilco Tool'S Circulating Tool; Admitted Prior Art.

* cited by examiner

*Primary Examiner* — Giovanna Wright
(74) *Attorney, Agent, or Firm* — Streets & Steele; Patrick K. Steele; Jeffrey L. Streets

(57) ABSTRACT

A downhole jetting tool is provided for cleaning the interior of one or more hydraulic rams (14, 18) and one or more annular blowout preventers (26, 28). A unitary jetting tool body (40) has a central throughbore (42) and a plurality of radially outward jets (42, 46). A tapered landing shoulder (50) on the tool body engages a frustoconical surface of a landing ring (22) to position the tool in the well.

20 Claims, 3 Drawing Sheets

OILFIELD JETTING TOOL

FIELD OF THE INVENTION

The present invention relates to a jetting tool for cleaning debris from well components. More particularly, the jetting tool may be used to clean the interior wellhead with a wear bushing therein having a restricted diameter throughbore and one or more hydraulic rams and/or annular blowout preventers having an enlarged diameter throughbore.

BACKGROUND OF THE INVENTION

Downhole jetting tools have been used for decades to clean debris along the wellbore, including debris in components positioned along the well, such as hydraulic rams and annular blowout preventers (BOPs). The jetting force of the high pressure fluid passing through the central bore in the tool washes debris from the side of the wellbore or from the interior of tools along the wellbore, and the dislodged material then can be returned to the surface and the fluid cleaned and reused. By reliably cleaning a wellbore, efficient drilling and the recovery of hydrocarbons is enhanced. The reliability of downhole components, such as hydraulic rams, annular blowout preventers and wear bushings, is also increased by cleaning debris from pockets within the tool which, if filled with debris, may cause equipment malfunctions. Cleaning tools are particularly useful in applications where metal shot is used to assist in drilling through hard formations, since the metal shot may become lodged in cavities within the downhole equipment, and the equipment may then not function properly.

One example of a downhole jetting tool is Bilco Tool's Wellhead Jet Tool, which includes jets to clean subsea annular blowout preventers. This tool is not capable, however, of effectively cleaning annular BOP's with a large diameter bore positioned above a wellhead with a drilling wear bushing therein having a reduced diameter bore. Another type of jet tool essentially utilizes an upper jet tool similar to the Bilco Wellhead Jet Tool, and a lower jet tool with a reduced diameter intended for positioning within wellhead. The two tools are connected by threaded components, which involve significant cost in reliably maintaining and testing the threaded connections for different runs or jobs. These threaded connections detract from the overall strength of the tool if the tool gets stuck in the well, since separation of the upper and lower tools will likely occur at the threaded connection. Moreover, this combined tool is not reliably positioned in the well with respect to the downhole equipment to be cleaned, and accordingly more time and effort is commonly used to repeatedly raise, lower, and rotate the combined tool with the hope that the critical cavities will be effectively cleaned by the jets.

The disadvantages of the prior art are overcome by the present invention, an improved downhole jet tool is hereinafter disclosed.

SUMMARY OF THE INVENTION

In one embodiment, a downhole jetting tool is provided for cleaning the interior of a wellhead with a wear bushing therein having a restricted diameter throughbore, and the interior of one or more hydraulic rams and/or annular blowout preventers above the hydraulic rams each having an enlarged diameter throughbore greater than the restricted diameter throughbore. The wear bushing in the wellhead below the hydraulic rams has a frustoconical landing surface thereon. The jetting tool includes a unitary tool body having a central throughbore and a plurality of radially outward jets each extending from the throughbore to either an upper large diameter outer surface or a lower small diameter outer surface of the jetting tool, such that the small diameter portion of the jetting tool is positioned within the restricted diameter throughbore of the one or more hydraulic rams and the large diameter outer surface of the jetting tool is positioned within the enlarged diameter throughbore of the one or more annular blowout preventers. A tapered landing shoulder on the tool body connects the upper large diameter outer surface of the tool and the lower small diameter outer surface of a tool, and engages the frustoconical surface of the wear bushing.

These and further features and advantages of the present invention will become apparent from the following detailed description, wherein reference is made to the figures in the accompanying drawings.

DETAILED DESCRIPTION OF PREFERRED EMBODIMENTS

Figure 1:
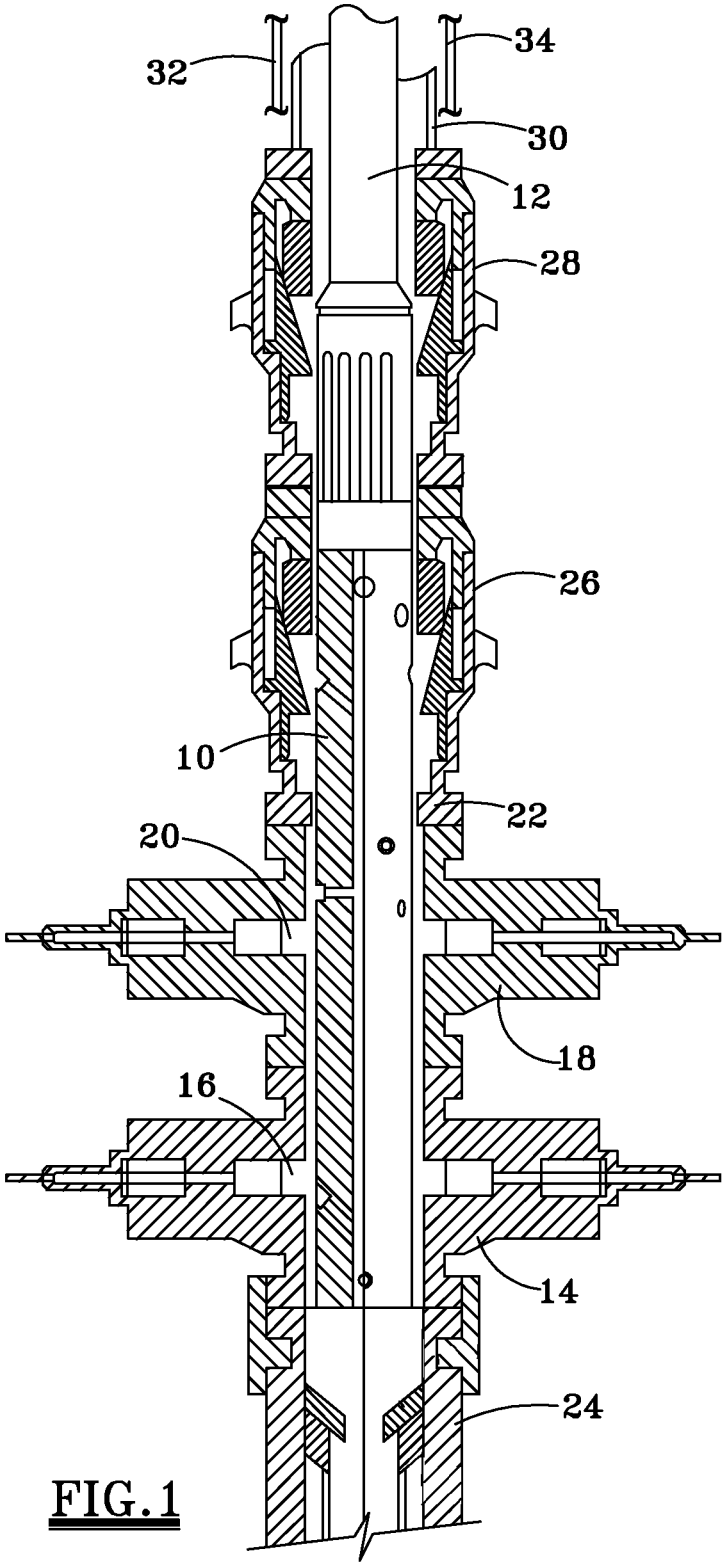
FIG. 1 illustrates a jetting tool positioned within a wellhead having a wear bushing therein and one or more hydraulic rams and annular blowout preventers for cleaning cavities within the downhole components.

A jetting tool 10 as shown in cross-section in FIG. 1 is supported on a workstring 12 extending to the surface. When jetting tool 10 is landed, as explained subsequently a lower portion of the tool is received within the interior of a subsea wellhead 24 having a wear bushing 22 therein. A bull nose 20 may extend downward from the jetting tool, or a workstring may extend downward from the jetting tool. An upper portion of the tool 10 is received within the interior of hydraulic shear rams 14, 18. Each of the rams 14, 18 has one or more cavities 16, 20 which are desirably cleaned of debris by the jetting tool. When landed, the upper large diameter portion of the tool also fits within the annular blowout preventer 26, 28. The riser 30 extends upward from the annular blowout preventer 28 to the surface, and conventionally includes one or more control lines 32, 34, commonly known as choke and kill lines, for controlling operation of the rams and the annular blowout preventers (BOPs).

Figure 2:
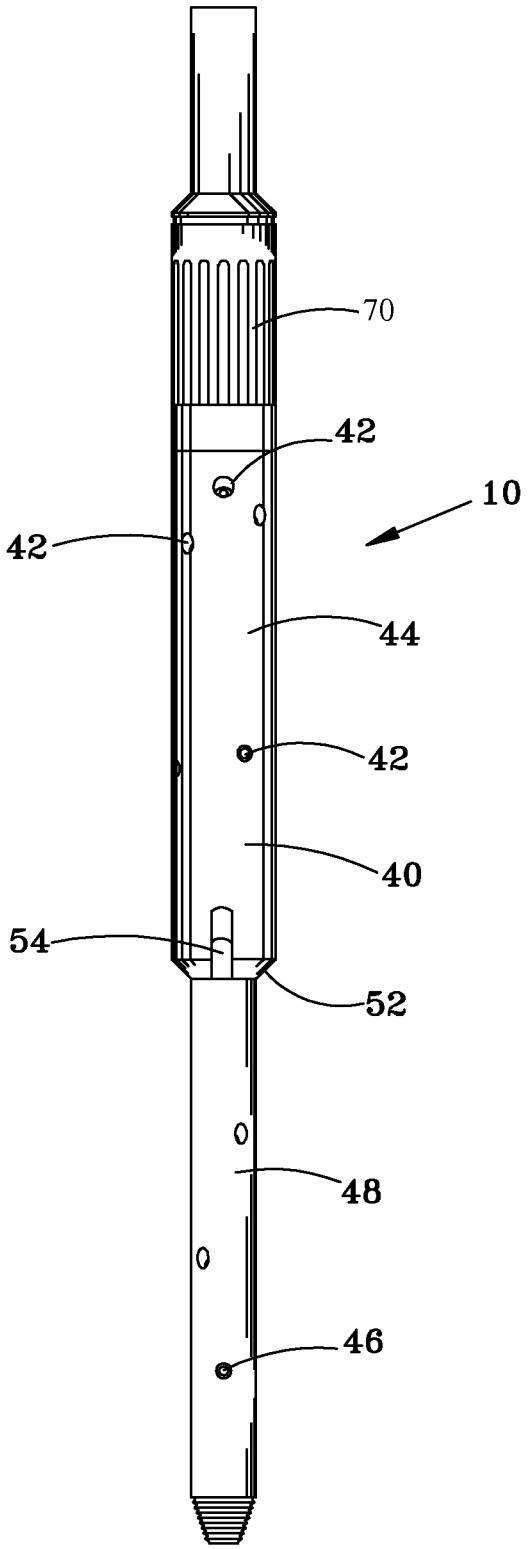
FIG. 2 is a side view of the jetting tool shown in FIG. 1.

FIG. 2 illustrates a side view of jetting tool 10, which includes a unitary tool body 40 having a plurality of upper jets 42 at different angles in the large diameter portion 44 of the tool body, and a plurality of lower jets 46 of different diameters in the lower small diameter portion 48 of the tool body. By providing a unitary tool body 40 that supports both the upper and lower jets, a rugged and robust tool is obtained, which is particularly important for cleaning well components. The small diameter portion 48 of the tool body has a reduced diameter for fitting within the wellhead and the large diameter upper portion of the tool body fits within the larger bore of the rams and/or the annular BOPs.

In order to enhance reliability, the jetting tool 10 may be positioned in the well at a known location with respect to the components 22, 14, 18, 26 and 28. The tool accordingly includes a plurality of circumferentially spaced shoulders 52 which engage the tapered upper surface on the wear bushing. A plurality of circumferentially spaced cutouts or flutes 54 between these spaced shoulders provide a flow path axially past the wear bushing when the tool body is landed on the wear bushing, so that fluid jetted from the lower portion of the tool may pass upward through these cutouts and to an annular between the OD of the tool and the interior of the annular BOPs.

By knowing a landing position of the jetting tool with respect to the components to be cleaned, the cleaning operation itself is enhanced. The axial spacing between the components to be cleaned and their bore diameters are known before the jetting operation commences, but prior art tools tended to clean an axially longer area that was required or did not perform an adequate cleaning job because the position of the jetting tool with respect to the components to be cleaned was assumed, not known. When the present tool is landed on the wear bushing, the jets in the jetting tool may be ideally positioned for cleaning one or more components at that landed position, i.e. cleaning the wear bushing 22, the interior of the wellhead 24, the hydraulic rams, and the annular BOPs. Moreover, other components can be reliably cleaned by raising the tool from its landed position a precise distance, e.g., 72 inches, so that jets in the raised tool are precisely positioned for cleaning other components. When in any position, the tool can be easily rotated by rotating a workstring, and also can be reciprocated while rotating.

The wear bushing is another component in the well which desirably is cleaned with the jetting tool as it is rotated and/or reciprocated in the wells, thereby providing a reliable seating surface and increasing the likelihood that the wear bushing subsequently may be retrieved to surface.

A feature is that the tool can be reliably used when manipulating a workstring without opening and closing various ports in the tool with balls or other closure members. Ball dropping operations may be unreliable, and commonly incur the use of additional personnel not normally working at the rig site.

Figure 3:
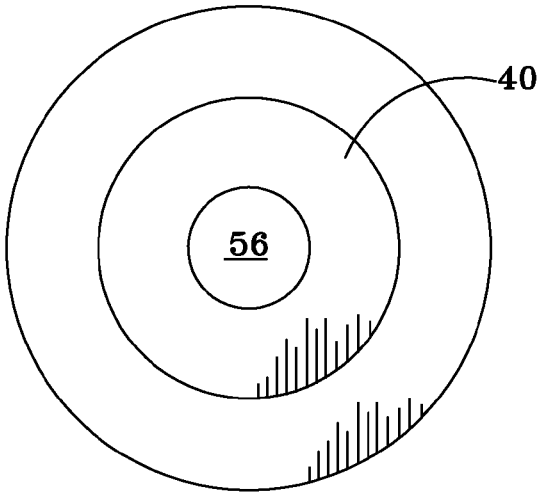
FIG. 3 is a top view of the jetting tool shown in FIG. 2.
Figure 4:
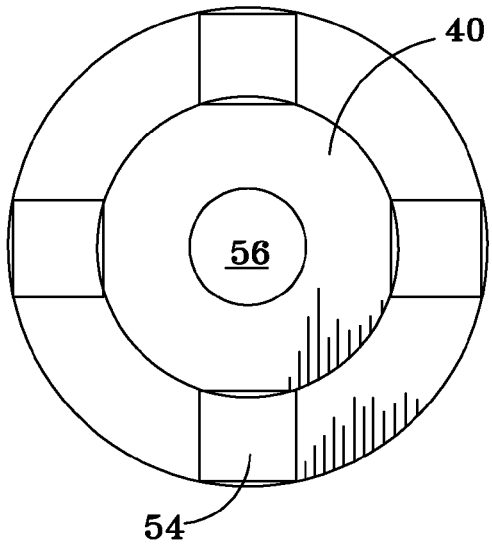
FIG. 4 is a bottom view of the jetting tool shown in FIG. 2.

FIG. 3 illustrates a top view of the tool shown in FIG. 2, and FIG. 4 illustrates a bottom view of the tool shown in FIG. 2. The cutouts 54 in the tool body are shown in FIG. 4, and a plurality of circumferentially spaced cutouts are preferably provided each spaced between a pair of landing shoulders. The central throughbore 56 in the tool body is also shown in FIGS. 3 and 4.

Figure 5:
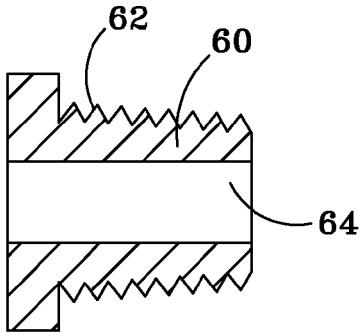
FIG. 5 is a cross-sectional view of a suitable nozzle.
Figure 6:
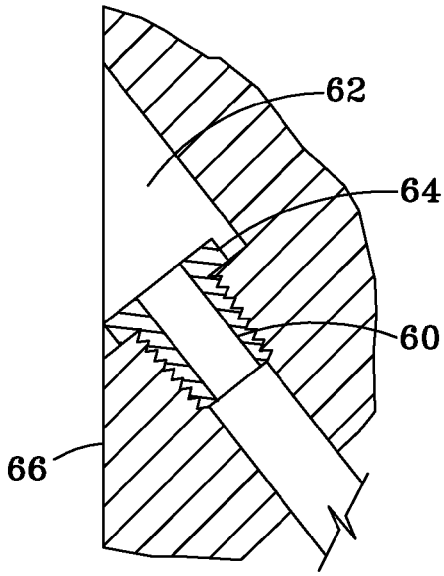
FIG. 6 illustrates an inclined nozzle fixed to the tool body.

The jets as disclosed herein are generally cylindrical nozzles 60 as shown in FIG. 5 with a threaded exterior surface 62 to connect with mating threads in the side wall of the tool body and a jetting flow path 64 in the nozzle. The diameter of the ports in the nozzles may depend upon the application, but commonly have a jet bore diameter of from ⅝ inch to ⅞ inch. The nozzle bore is preferably sized to do effective cleaning, but not cut or damage elastomeric components within the assembly being cleaned. FIG. 6 illustrates one of the nozzles 60 provided within a recessed pocket 62 in a tool body. Hex flange 64 may thus be torqued to secure the nozzle 60 in place within the tool. The FIG. 6 nozzle is angled, e.g. at 45°, with respect to the outer wall 66 of the tool body. Preferably at least some of the nozzles in both the upper and lower portions of the tool have a substantially radial jet, while other nozzles in each portion have angled jets, e.g., 45°, 30°, 60° angled jets. Each nozzle, regardless of whether a radial jet or an angled jet, is positioned radially inward of an outer surface of the tool body, thereby protecting the nozzle from damage The jetting tool in the present invention preferably includes a plurality of circumferentially spaced magnets 70 as shown in FIG. 2 positioned on slots provided on the exterior surface of the tool body. The debris discharged by the jets and moving upward into the annulus exterior of the tool body is passed directly by the magnets 70, which attract metal particles that are particularly destructive to downhole tool operations. These particles are attracted to the magnets and can be recovered when the tool is returned to the surface. FIG. 2 also illustrates a plurality of elongate and circumferentially spaced magnets supported on the tool body.

The jetting tool as disclosed herein is particularly suitable for cleaning a components in a subsea well. The jetting tool may also be used, however, to clean hydraulic rams and annular blowout preventers in a land-based or surface well. The wear bushing disclosed is commonly used in wells when drilling. In other applications, including surface applications, the wear bushing may be replaced with a hanger or a landing ring having a frustoconical landing surface thereon. Each of these components, when positioned in a wellhead, may be termed a "landing ring", and may be slotted or a full annular ring. Various types of wear bushings, hangers and lending rings may be used for landing the jetting tool, and thereby knowing precisely the position of the jetting tool with respect to the components to be cleaned.

The jetting tool as disclosed herein is particularly suitable for cleaning well components of metal shavings or other metal particles, including metal shavings from window cutting and milling operations. In other applications, as disclosed above, metal shot has been used when drilling to assist in drilling through hard formations. In either case, the jetting tool reliably cleans those internal pockets from metal shavings, cutting, or shot and from other debris in the well which may adversely affect well component operations.

Although specific embodiments of the invention have been described herein in some detail, this has been done solely for the purposes of explaining the various aspects of the invention, and is not intended to limit the scope of the invention as defined in the claims which follow. Those skilled in the art will understand that the embodiment shown and described is exemplary, and various other substitutions, alterations and modifications, including but not limited to those design alternatives specifically discussed herein, may be made in the practice of the invention without departing from its scope.

What is claimed is:

1. A jetting tool to clean interior cavities of a wellhead having a landing ring therein with a landing surface and a restricted diameter throughbore, and to clean interior cavities of one of a hydraulic ram and an annular blowout preventer connected above the wellhead and having an enlarged diameter throughbore that is greater than the restricted diameter throughbore of the landing ring of the wellhead, the jetting tool comprising:

a unitary body having a central throughbore and a plurality of radially outward jets each extending from the central throughbore of the body to one of an upper large diameter outer surface of the jetting tool and a lower small diameter outer surface of the jetting tool, such that the lower small diameter outer surface of the jetting tool is positioned within the restricted diameter throughbore of the landing ring and the upper large diameter outer surface of the jetting tool is positioned within the enlarged diameter throughbore of the one of a hydraulic ram and an annular blowout preventer and a plurality of circumferentially spaced and tapered landing shoulders on the body intermediate the upper large diameter outer surface of the tool and the lower small diameter outer surface of the jetting tool, the tapered landing shoulders sized and angled to engage corresponding supports of the landing surface of the landing ring of the wellhead;

wherein fluid pumped into the jetting tool exits the jetting tool through the plurality of radially outward jets to impinge upon and to thereby clean debris from interior cavities along the enlarged diameter throughbore and the landing ring.

2. The jetting tool of in claim 1, further comprising:

a plurality of magnets supported on the body of the jetting tool above the upper large diameter outer surface of the jetting tool to attract and retain metal particles released from the cavities along the enlarged diameter throughbore by the plurality of radially outward jets.

3. The jetting tool of claim 1, wherein the body includes a plurality of circumferentially spaced cutouts extending through the tapered landing shoulder for passing fluid upward past the landing ring when the tapered landing shoulders of the body engage the landing surface of the landing ring.

4. The jetting tool of claim 1, wherein a plurality of circumferentially spaced upper jets extend from the central throughbore through to the upper large diameter outer surface of the jetting tool; and wherein a plurality of circumferentially spaced lower jets extend from the central throughbore through to the lower small diameter outer surface of the jetting tool.

5. The jetting tool of claim 4, wherein the plurality of upper jets extending from the central throughbore through to the upper large diameter outer surface of the jetting tool includes a plurality of substantially radial jets and a plurality of angled jets, and the plurality of lower jets extending from the central throughbore through to the lower small diameter outer surface of the jetting tool include a plurality of substantially radial jets and a plurality of angled jets.

6. The jetting tool of claim 1, wherein each of the plurality of radially outward jets include a nozzle threadedly connected within a pocket.

7. The jetting tool of claim 6, wherein each nozzle included in a radially outward jet extending from the central throughbore of the body through to the upper large diameter outer surface of the jetting tool is threadably secured within the pocket radially inward of the upper large diameter outer surface of the jetting tool; and wherein each nozzle included in a radially outward jet extending from the central throughbore of the body through to the lower small diameter outer suffice of the jetting tool is threadably secured within the pocket radially inward of the lower small diameter outer surface of the jetting tool.

8. A jetting tool to clean a wellhead having a landing ring therein with a frustoconical landing surface thereon, the landing ring having a restricted diameter throughbore, and to clean one of a hydraulic ram and an annular blowout preventer above the wellhead having an enlarged diameter throughhore greater than the restricted diameter throughhore of the landing ring, the jetting tool comprising:

a body having a central throughbore and a plurality of radially outward jets each extending from the central throughbore to one of an upper large diameter outer surface of the jetting tool and a lower small diameter outer surface of the jetting tool, such that the lower small diameter outer surface of the jetting tool is positioned within the restricted diameter throughbore of the landing ring and the upper large diameter outer surface of the jetting tool is positioned within the enlarged diameter throughhore of the one of the hydraulic ram and the annular blowout preventer;

a tapered landing shoulder on the body connecting the upper large diameter outer surface of the jetting tool and the lower small diameter outer surface of the jetting tool, the landing shoulder engaging the frustoconical surface of the landing ring; and the body includes a plurality of circumferentially spaced cutouts extending through the tapered landing shoulder to pass fluid upward past the landing ring when the tapered landing shoulder of the body engages the frustoconical surface of the landing ring.

9. The jetting tool of claim 8, further comprising:

a plurality of magnets supported on the body above the upper large diameter outer surface of the jetting tool to attract and retain metal particles released from interior cavities of the wellhead by the plurality of radially outward jets.

10. The jetting tool of claim 8, wherein each of the plurality of radially outward jets includes a nozzle threadably received within a pocket recessed within the tool body.

11. The jetting tool of claim 8, wherein a plurality of circumferentially spaced upper jets extend from the central throughbore through to the upper large diameter outer surface of the jetting tool, and a plurality of circumferentially spaced lower jets extend from the central throughbore through to the lower small diameter outer surface of the jetting tool.

12. The jetting tool of claim 11, wherein each of the plurality of upper jets extending from the central throughbore through to the upper large diameter outer surface of the jetting tool includes a plurality of substantially radial jets and a plurality of angled jets, and each of the plurality of lower jets extending from the central throughbore through to the lower small diameter outer surface of the jetting tool includes a plurality of substantially radial jets and a plurality of angled jets.

13. The jetting tool of claim 8, wherein each of the plurality of radially outward jets include a nozzle threadedly connected within a pocket recessed within the body; and wherein each nozzle included in a radially outward jet extending from the central throughbore is threadably connected within a pocket radially inward of a respective outer surface of the jetting tool.

14. A method of cleaning a wellhead having landing ring therein with a restricted diameter throughbore and one of a hydraulic ram and an annular blowout preventer having an enlarged diameter throughbore greater than the restricted diameter throughbore, the method comprising:

providing a unitary jetting tool body having, a central throughbore and a plurality of radially outward jets each extending from the central throughbore to one of an upper large diameter outer surface of the jetting tool and a lower small diameter outer surface of the jetting tool;

providing the lower small diameter portion of the jetting tool within the restricted diameter throughbore of the landing ring and positioning the upper large diameter outer surface of the jetting, tool within the enlarged diameter throughbore of the hydraulic ram and the annular blowout preventer; and landing, at least one tapered shoulder on the body on a landing surface of the landing ring that corresponds to the taper on the at least one tapered shoulder of the body, the at least one tapered landing shoulder connecting the upper large diameter outer surthce of the jetting tool and the lower small diameter outer surface of the jetting tool.

15. The method of claim 14, further comprising:

supporting a plurality of magnets on the body above the upper large diameter outer surface of the jetting tool to attract and retain metal particles released from interior cavities of the wellhead by fluid exiting the plurality of jets of the jetting tool body.

16. The method of claim 14, further comprising:

forming a plurality of circumferentially spaced cutouts in the body extending through the at least one tapered landing shoulder to pass fluid upward past the landing ring when the body engages the landing ring.

17. The method of claim 14, wherein a plurality of circumferentially spaced upper jets extend from the central throughbore through to the upper large diameter outer surface of the jetting tool, and a plurality of circumferentially spaced lower jets extend from the central throughhore through to the lower small diameter outer surface of the jetting tool.

18. The method of claim 14, wherein each of the plurality of upper jets extending from the central throughbore through the upper large diameter outer surface of the jetting tool includes a plurality of substantially radial jets and a plurality of angled jets, and each of the plurality of lower jets extending through the lower small diameter outer surface of the jetting tool include a plurality of substantially radial jets and a plurality of angled jets.

19. The method of claim 14, wherein each of the plurality of radially outward jets include a nozzle threadably received within a pocket recessed within the tool body.

20. The method of claim 19, wherein each nozzle included in a radially outward jet extendinu from the central throughbore through to the upper large diameter outer surface of the jetting tool is positioned radially inward of the large outer diameter surface of the jetting tool; and wherein each nozzle included in a radially outward jet extending from the central throughbore thorugh to the lower small diameter outer surface of the jetting tool is positioned radially inward of the small outer diameter surface of the jetting tool.

* * * * *